US007798163B2

(12) United States Patent
Yang

(10) Patent No.: US 7,798,163 B2
(45) Date of Patent: Sep. 21, 2010

(54) AUXILIARY MODELING STRUCTURE FOR PLAYHOUSE

(76) Inventor: Wei Hen Yang, 3F., No.99, Yusheng St., Shihlin District, Taipei City 111 (TW)

( * ) Notice: Subject to any disclaimer, the term of this patent is extended or adjusted under 35 U.S.C. 154(b) by 209 days.

(21) Appl. No.: 12/008,341

(22) Filed: Jan. 10, 2008

(65) Prior Publication Data

US 2008/0169014 A1 Jul. 17, 2008

(30) Foreign Application Priority Data

Jan. 12, 2007 (TW) ..... 96101188 A

(51) Int. Cl.
*E04H 15/40* (2006.01)
*A63H 3/00* (2006.01)

(52) U.S. Cl. ..... 135/126; 135/136; 135/95; 135/120.3; 446/478; 446/72

(58) Field of Classification Search ..... 135/97, 135/124, 125–126, 128, 136, 115, 119, 120.3; 446/72–73, 76–77, 97–99, 369, 376, 478, 446/487; 24/662; 220/339, 9.2–9.3
See application file for complete search history.

(56) References Cited

U.S. PATENT DOCUMENTS 2,618,894 A * 11/1952 Nudelman et al. ..... 446/190
3,990,463 A * 11/1976 Norman ..... 135/126
4,736,847 A * 4/1988 Wang ..... 206/457
D296,955 S * 8/1988 Janney et al. ..... D3/254
4,950,196 A * 8/1990 Fortune et al. ..... 446/73
5,564,454 A * 10/1996 Curley et al. ..... 135/126
5,664,596 A * 9/1997 Zheng ..... 135/126
6,126,507 A * 10/2000 Lieberman ..... 446/327
6,302,127 B1 * 10/2001 Gayton ..... 135/124
6,357,462 B1 * 3/2002 Laosunthara et al. ..... 135/96
6,502,596 B1 * 1/2003 Danaher ..... 135/126
6,694,994 B1 * 2/2004 Zheng ..... 135/126
6,887,120 B2 * 5/2005 Shamitoff ..... 446/99
7,178,538 B2 * 2/2007 Ransom ..... 135/125
7,252,107 B2 * 8/2007 Chu et al. ..... 135/126
2003/0003840 A1 * 1/2003 Hsu et al. ..... 446/221
2009/0183758 A1 * 7/2009 Gospodinov et al. ..... 135/126

FOREIGN PATENT DOCUMENTS

GB 2195907 A * 4/1988

* cited by examiner

*Primary Examiner*—Winnie Yip

(57) ABSTRACT

An auxiliary modeling structure for playhouse comprises a frame body of playhouse, at least one auxiliary modeling unit, and at least one connecting module. The frame body has a bottom surface of a predetermined area and a cover enclosing the bottom surface. Each auxiliary modeling unit has an external surface which defines an attachable surface of a predetermined area. Each connecting module further includes a first connecting part and a second connecting part. The second connecting part is connectable with the first connecting part in a detachable manner; wherein one of the first and second connecting parts is furnished on the frame body, while the other one is furnished on the auxiliary modeling unit. By using the second connecting part to connect the first connecting part, the auxiliary modeling unit can be connected to the predetermined location of the frame body so as to make the playhouse shaped like a three-dimensional animal, fruit, daily utensil, transportation, or etc.

8 Claims, 19 Drawing Sheets

AUXILIARY MODELING STRUCTURE FOR PLAYHOUSE

BACKGROUND OF INVENTION

1. Field of the Invention

The invention relates to an auxiliary modeling structure, and more particularly, to an auxiliary modeling structure for attaching to playhouse, thereby imparting particular styles to the playhouse.

2. Description of the Prior Art

Generally, playhouses are classified as either toy or furniture for children, and have gained wide market share throughout the world. Playhouses are not only of a wide diversity of shapes and styles, but also inexpensive and easy to put away for storage, which makes it popular among children. There are currently five types of playhouses available; they are hard-shelled type, inflatable type, tent type, flexible type, and pipe-fitting type. However, all of the currently available playhouses have the following disadvantages:

1. Poor quality of material: Current playhouses are generally made of nylon fabrics and have iron supporting frames, in which the nylon fabrics are prone to tearing and iron supporting frames become rusty easily. Under safety considerations, some countries have safety standards that require manufacturers to enclose the iron supporting frames with a layer of plastic. Even so, some consumers still consider the iron supporting frames are not robust enough.

2. Short product lifespan: Because the playhouses have become a matured product, the competition between the manufacturers for market share is intense, hence each manufacturer must try to product playhouses on a low budget. As a result, a large number of playhouses are made of cheap materials, which in turn leads to the aforesaid problem of poor material quality, and thus the lifespan of playhouses is reduced. Once playhouses wear out quickly, parents or teachers become reluctant to purchase another playhouse.

3. Poor diversity of styles: Due to the limitation of materials, playhouses rarely come in diverse shapes or styles; manufacturers often simply vary the printed pattern of playhouses instead of varying the shapes and styles of playhouses. Observation from the Internet and comments from the manufacturers indicated that playhouses shaped as animals are especially rare in the market.

Therefore, it is urgent to find solutions to the above-mentioned disadvantages of the prior arts, and enhance other functions of playhouses as demanded by consumers, so as to make playhouses more durable and increase the market share thereof.

SUMMARY OF INVENTION

A primary objective of the invention is to propose an auxiliary modeling structure for playhouses, which has connectable and separable connecting parts separately disposed on a playhouse and the auxiliary modeling structure, so as to allow the auxiliary modeling structure to be conveniently attached to or separated from the playhouse.

Another objective of the invention is to propose an auxiliary modeling structure for playhouses, which has a filling therein for making the auxiliary modeling structure more three-dimensional when being attached to the playhouse.

Still another objective of the invention is to propose an auxiliary modeling structure for playhouses, which has several foldable supporting frames in the playhouse, so that the playhouse may be put away for storage or unfolded for use promptly.

Yet another objective of the invention is to propose an auxiliary modeling structure for playhouses, which has several supporting frames in the playhouse for upholding the frame body of the playhouse, so that the playhouse is imparted with larger internal space, more ventilation, and three-dimensional structure.

A further objective of the invention is to propose an auxiliary modeling structure for playhouses, which has several supporting frames in the playhouse for upholding the frame body of the playhouse, so as to provide protective shelter for young children, and allow the children to play safely therein.

In order to achieve the aforementioned objectives, the present invention discloses an auxiliary modeling structure for playhouse comprises a frame body of playhouse, at least one auxiliary modeling unit, and at least one connecting module. The frame body has a bottom surface of a predetermined area and a cover enclosing the bottom surface. Each auxiliary modeling unit has an external surface which defines an attachable surface of a predetermined area. Each connecting module further includes a first connecting part and a second connecting part. The second connecting part is connectable with the first connecting part in a detachable manner; wherein one of the first and second connecting parts is furnished on the frame body, while the other one is furnished on the auxiliary modeling unit. By using the second connecting part to connect the first connecting part, the auxiliary modeling unit can be connected to the predetermined location of the frame body so as to make the playhouse shaped like a three-dimensional animal, fruit, daily utensil, transportation, or etc.

In a preferred embodiment, the first connecting part further includes a positioning ring and a first connecting strip, the first connecting strip is passing through the positioning ring and fixed to the frame body; the second connecting part further includes a positioning clip and a second connecting strip, the second connecting strip is passing through the positioning clip and fixed to the auxiliary modeling unit; by using the positioning clip to clip the positioning ring, the auxiliary modeling unit is connected to the frame body. The positioning clip further includes an opening portion at a front end thereof and a through hole at its rear end, the opening portion is shaped like a duck beak; wherein the second connecting strip is passing through the through hole.

In a preferred embodiment, the first and second connecting parts are chosen from one of the following: magnets with opposite magnetic polarities, zippers and nylon fasteners.

In a preferred embodiment, at least one trough is openly formed in each auxiliary modeling unit, and each trough has two edges and a top where the two edges converge; wherein by connecting and joining the two edges, the auxiliary modeling unit becomes three-dimensional; wherein the two edges are connected together by one of the following methods: sewing, zipping, laminating, and adhering.

In a preferred embodiment, each auxiliary modeling unit is filled with a filling in order to make the auxiliary modeling unit three-dimensional; wherein the filling is selected from one of the following: polyethylene foam, cotton fiber, fabrics, and gases.

In a preferred embodiment, each of the auxiliary modeling units further comprises at least one frame aligned in a predetermined arrangement, the frame upholds the auxiliary modeling unit and makes the auxiliary modeling unit three-dimensional.

In a preferred embodiment, the playhouse further comprises several supporting frames aligned in a predetermined arrangement, each supporting frame includes at least two arc-shaped surfaces, at least one overlapping end, and two pressing ends; each of the two pressing ends respectively presses against inner edges of the bottom surface and upholds the cover away from the bottom surface; wherein the arc-shaped surfaces, overlapping end and pressing ends of each supporting frame are formed by bending a single continuous metal wire into a shape of "8".

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF PREFERRED EMBODIMENTS

Figure 1:
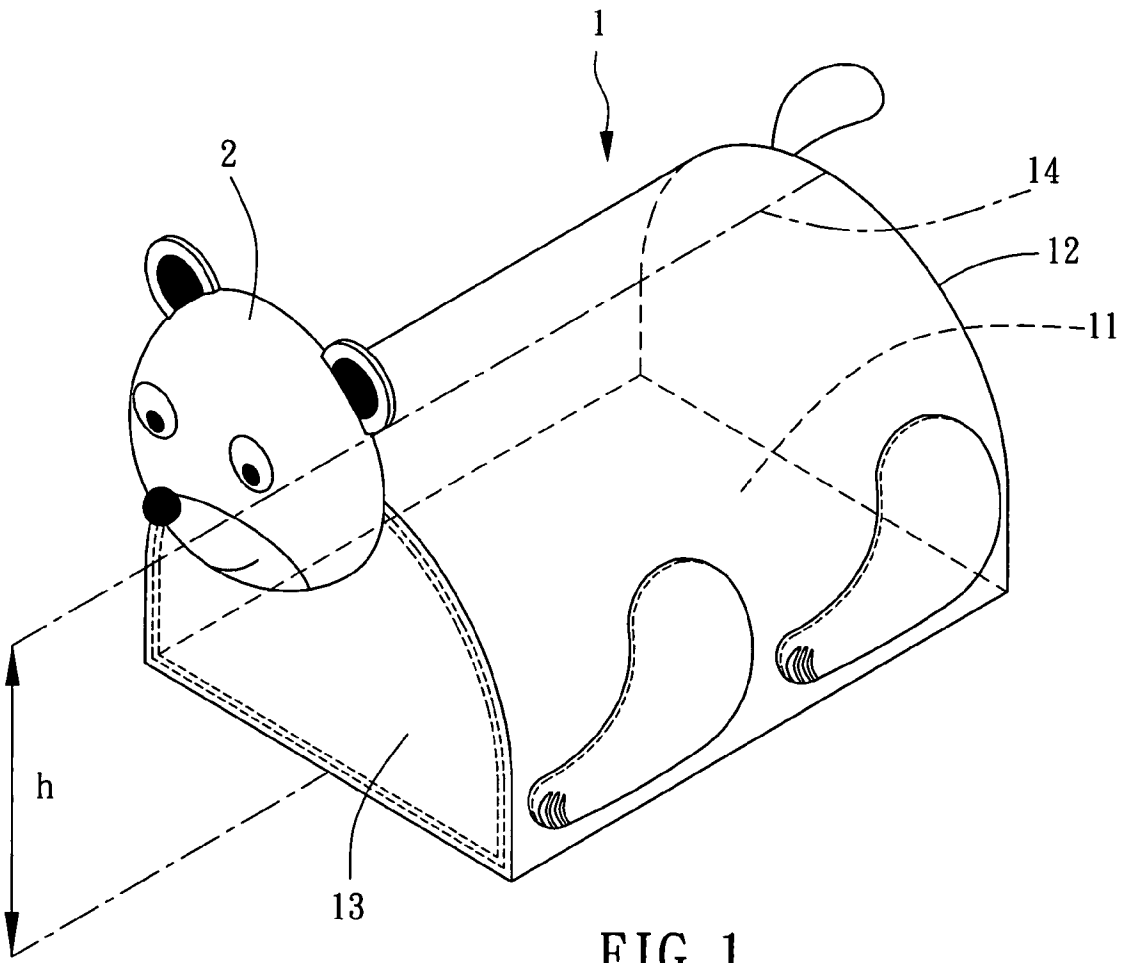
FIG. 1 is a three-dimensional structural view that shows the first preferred embodiment of a playhouse according to the invention.

FIG. 1 is a three-dimensional structural view that shows the first preferred embodiment of an auxiliary modeling structure for playhouse according to the invention. Accordingly, the auxiliary modeling structure for playhouse comprises: a frame body 1 and several auxiliary modeling units 2. The frame body 1 has a bottom surface 11 of a predetermined area, and a cover 12 which encloses and defines the bottom surface 11. Two lateral sides 13 of the cover 12 are respectively formed into a curved surface. At least one peak 14 is formed on the cover 12, and a height "h" is spaced between the peak 14 and the bottom surface 11. The bottom surface 11 and cover 12 of frame body 1 define an empty compartment therein so as to allow the children to stay and play therein. The frame body 1 may be integrally formed by using materials including polyethylene foam, cotton fiber, or unwoven fabrics.

Figure 2A:
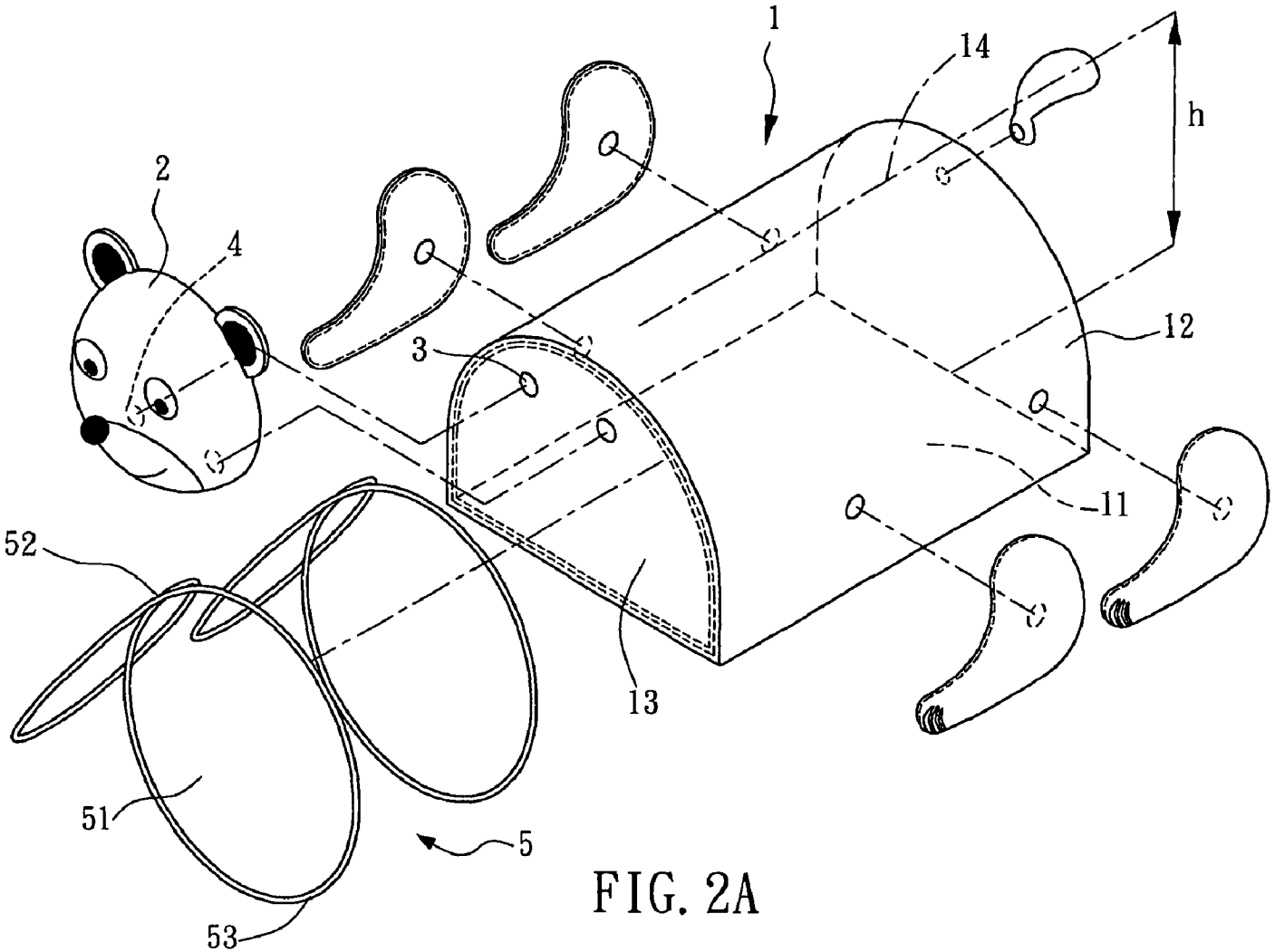
FIG. 2A is a three-dimensional exploded view that shows the second preferred embodiment of a playhouse according to the invention.
Figure 2B:
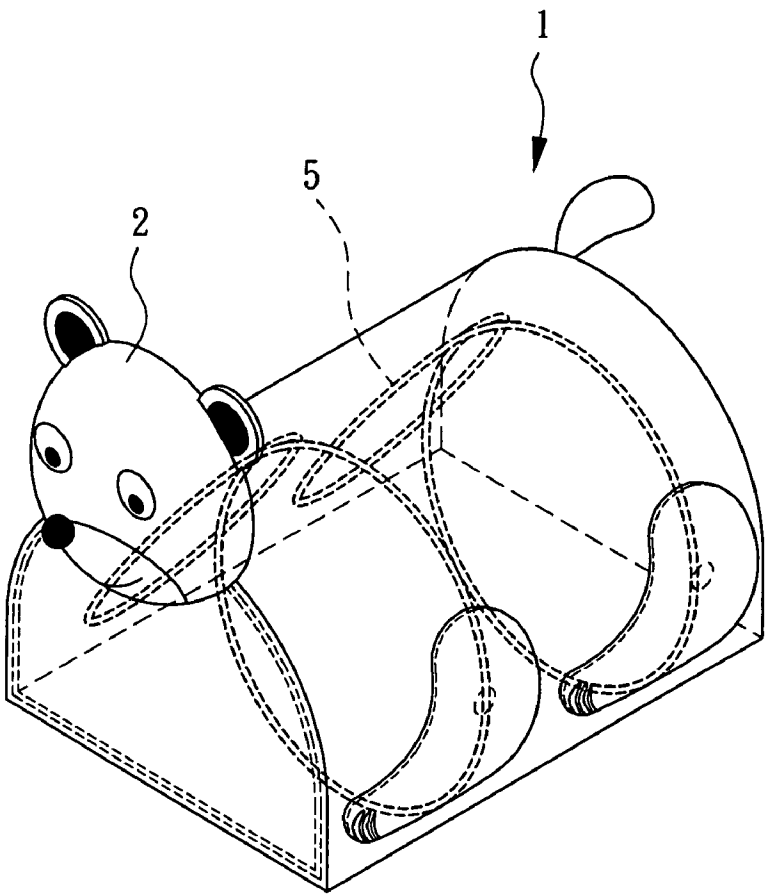
FIG. 2B is a three-dimensional assembled view that shows the second preferred embodiment of a playhouse according to the invention.

FIGS. 2A and 2B are the three-dimensional exploded and assembled views that show the second preferred embodiment of a playhouse according to the invention. Accordingly, the playhouse comprising: a frame body 1, a plurality of first connecting parts 3, a plurality of auxiliary modeling units 2, and a plurality of second connecting parts 4. The frame body 1 has a bottom surface 11 of a predetermined area, and a cover 12 encloses and defines the bottom surface 11. Two lateral sides 13 of the cover 12 are respectively formed into a curved surface. At least one peak 14 is formed on the cover 12, and a height "h" is spaced between the peak 14 and the bottom surface 11. In this embodiment, the first connecting part 3 is disposed on the cover 12, while the second connecting part 4 is disposed on the auxiliary modeling unit 2. The second connecting part 4 may be aligned and attached to the first connecting part 3 in a detachable manner, so that the auxiliary modeling unit 2 may be attached onto and also detached from the frame body 1 by means of the first and second connecting parts 3, 4. By attaching or separating the first connecting part 3 and the second connecting part 4, the auxiliary modeling unit 2 may be conveniently assembled to the frame body 1 or separated for storage.

In the preferred embodiment of the invention, the playhouse further comprises several supporting frames 5 aligned in a predetermined arrangement, each supporting frame 5 includes at least two arc-shaped surfaces 51, at least one overlapping end 52, and two pressing ends 53. The supporting frames 5 may be directly located within the cover 12, each of the two pressing ends 53 presses against the inner edges of the bottom surface 11 and upholds the cover 12 away from the bottom surface 11 by the elasticity of the supporting frames 5, so that the overlapping end 52 presses against the peak 14 of the cover 12. In this preferred embodiment, the arc-shaped surfaces 51, overlapping end 52 and pressing ends 53 of each supporting frame 5 are substantially formed by bending a single continuous metal wire into a shape of "8". The supporting frames 5 may be located on the outer surface or the inner surface of the cover 12, and has the overlapping end 52 secured at the peak 14 of the cover 12 by the means of a fixing component (not shown in the figures). As it will be understood by one ordinarily skilled in the art that numerous variations of the supporting frame 5 will be possible to the disclosed embodiment without departing from the scope of the invention, and thus the variations of the structures and figures will not be described further herein.

In the other preferred embodiments of the invention described hereafter, because most of the components are identical or similar to the ones mentioned in the previous embodiments, the identical components will be described by using the same names and numerals, and similar components will also be described by using the same names and numerals, except that the numerals will be followed by an alphabet to fulfill the purpose of distinction; the similar components will not be described in further details.

Figure 3A:
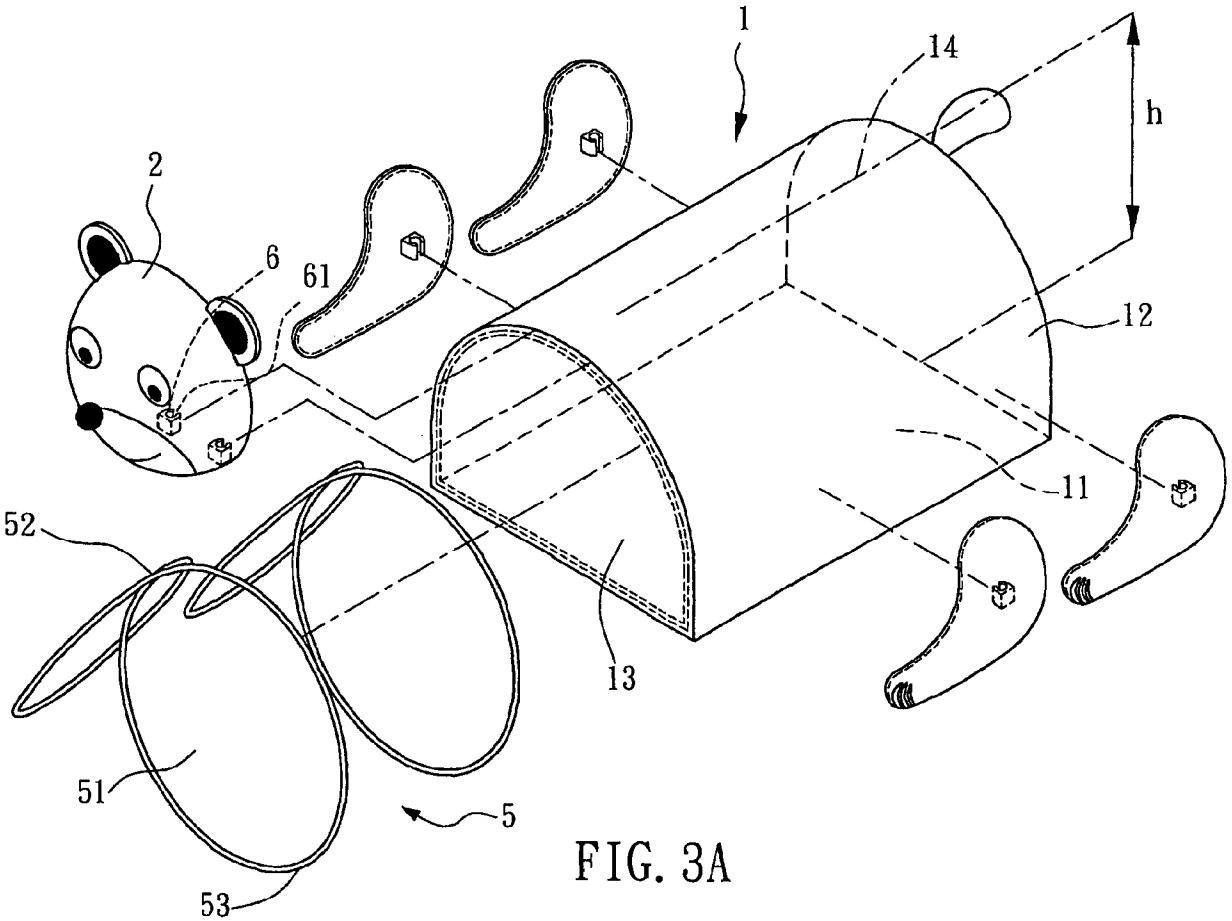
FIG. 3A is a three-dimensional exploded view that shows the third preferred embodiment of a playhouse according to the invention.
Figure 3B:
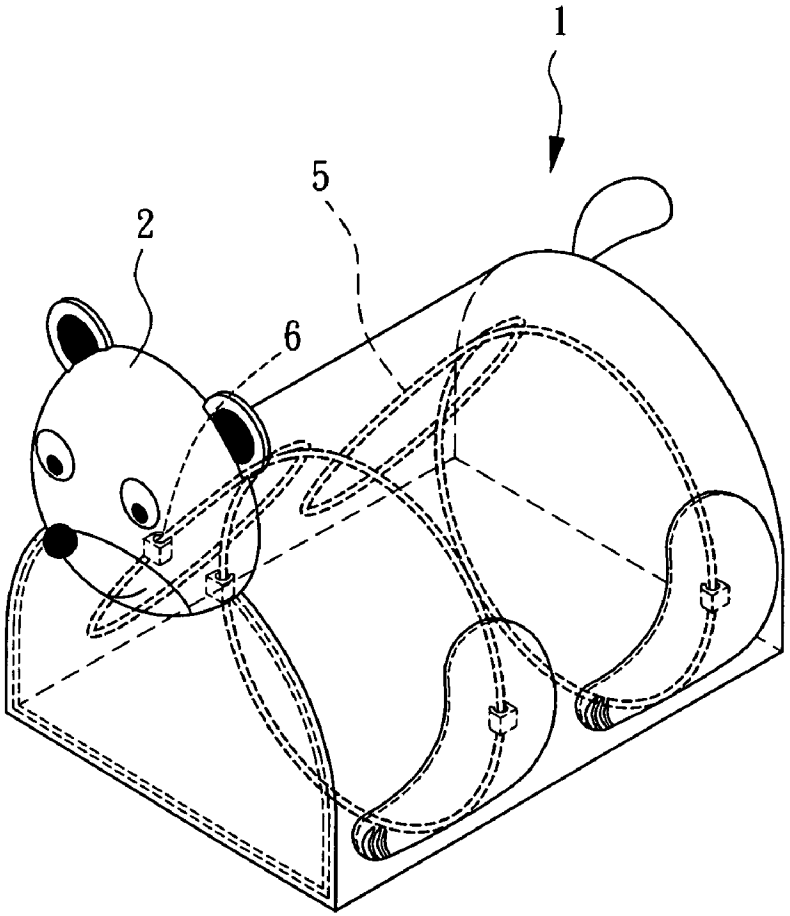
FIG. 3B is a three-dimensional assembled view that shows the third preferred embodiment of a playhouse according to the invention.

FIGS. 3A and 3B are the three-dimensional exploded and assembled views that show the third preferred embodiment of a playhouse according to the invention. In this preferred embodiments, each auxiliary modeling unit 2 is furnished with at least one connecting part 6 thereon, and the connecting part 6 has an opening 61. In this preferred embodiment, the connecting part 6 is a clip. If an external force is exerted on the two lateral sides of the connecting part 6, the size of the opening 61 may be adjusted so as to allow the supporting frames 5 to pass through the opening 61. Once the external force is removed, the connecting part 6 resumes its original form by the means of inherent elasticity, thus connecting the connecting part 6 to the supporting frames 5. In other words, the connecting part 6 and the supporting frames 5 are clamped together, which does not depart from the scope of the invention. However, in another preferred embodiment of the present invention, the clip (i.e., the connecting part 6) is in a different shape and can clip on different part of the frame body 1 other than the supporting frames 5.

Figure 4A:
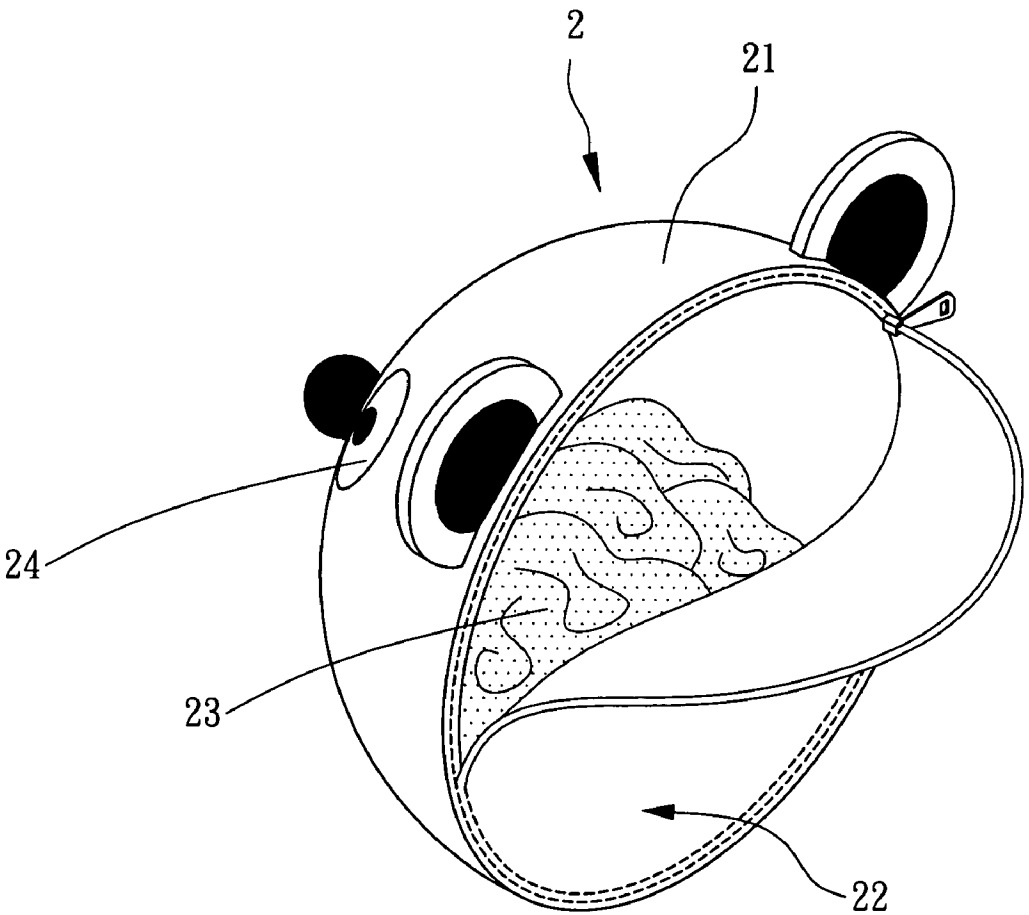
FIG. 4A is a three-dimensional structural view that shows the first preferred embodiment of an auxiliary modeling structure according to the invention.

Referring to FIG. 4A, which is a three-dimensional structural view that shows the first preferred embodiment of an auxiliary modeling structure according to the invention. In this preferred embodiment, each auxiliary modeling unit 2 has an external surface 21 encloses and defines an attachable surface 22 of a predetermined area, and the attachable surface 22 may be integrally connected to the frame body 1 by using methods including sewing or gluing. The auxiliary modeling unit 2 may be integrally formed from materials including polyethylene foam, cotton fiber, or non-woven fabrics, and includes a filling 23 therein so as to make the external surface 21 protrude outwardly from the attachable surface 22, that is, to make the auxiliary modeling unit 2 into the three-dimensional structure. The filling 23 may be made of polyethylene foam, cotton fiber, or fabrics; while it may also be a plastic sleeve (not shown in the figure) filled with gases. The auxiliary modeling unit 2 may further have a pattern 24 (such as eyes, nose, leg, palm, tail, and etc.) disposed thereon via methods including printing, embroidering, adhering, and sewing, so that the auxiliary modeling unit 2 may be imparted with particular styles that resemble the three-dimensional shapes of animals, fruits, daily utensils, or transportation.

Figure 4B:
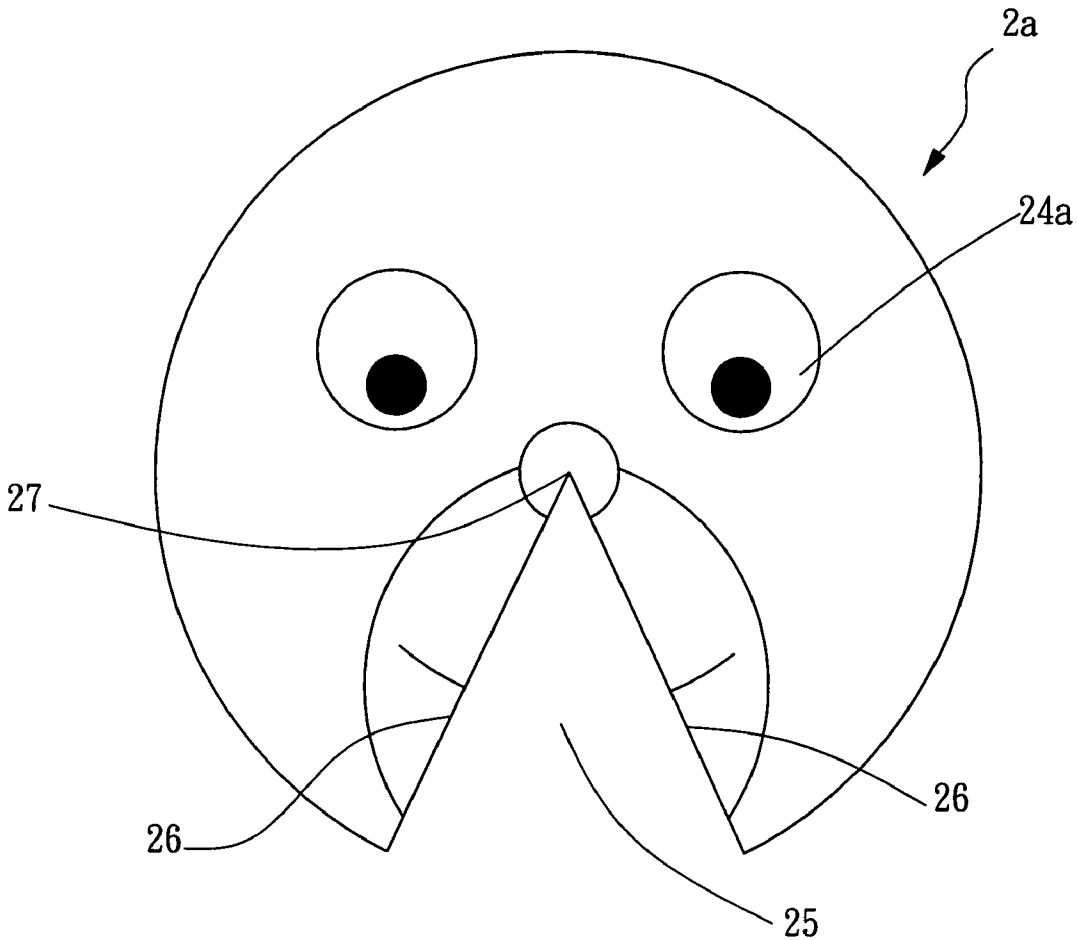
FIG. 4B is a schematic view that shows the second preferred embodiment of an auxiliary modeling structure before assembling according to the invention.
Figure 4C:
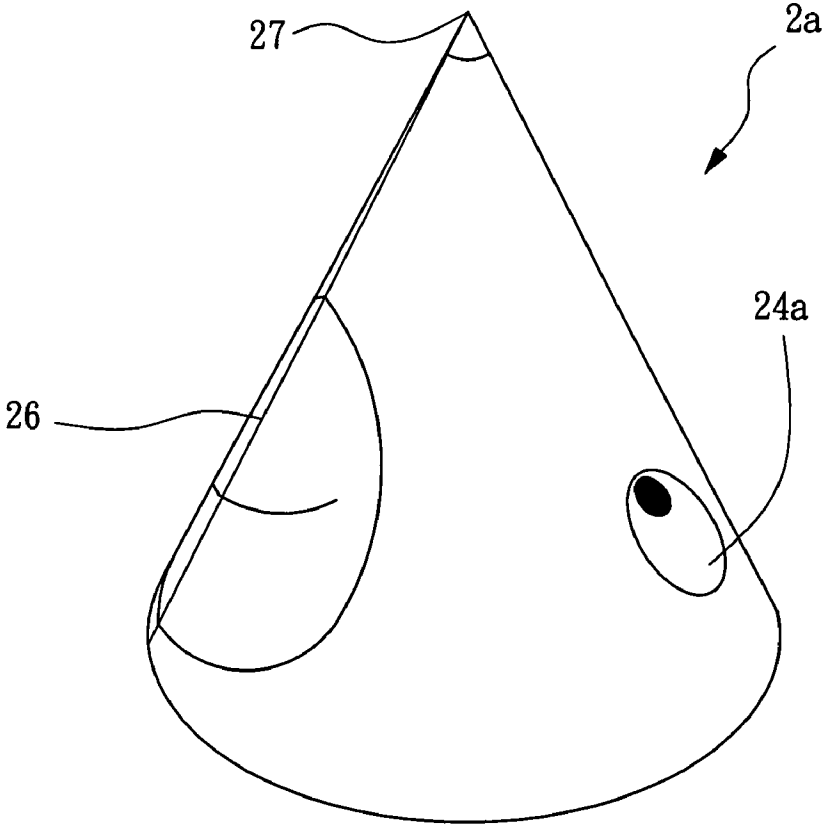
FIG. 4C is a schematic view that shows the second preferred embodiment of an auxiliary modeling structure after assembling according to the invention.

Referring to FIGS. 4B and 4C, which are schematic views that show the second preferred embodiment of an auxiliary modeling structure before and after assembling according to the invention. Accordingly, a trough 25 is openly formed in each of the auxiliary modeling unit 2*a*, respectively; and each trough 25 has two edges 26 and a top 27 where the two edges 26 converge, the two edges 26 are connected via methods including sewing, zipping, laminating, and adhering, so as to make the auxiliary modeling unit 2*a* three-dimensional. The auxiliary modeling unit 2*a* may further include a pattern 24*a* disposed thereon via methods including printing, sewing, and gluing.

Figure 4D:
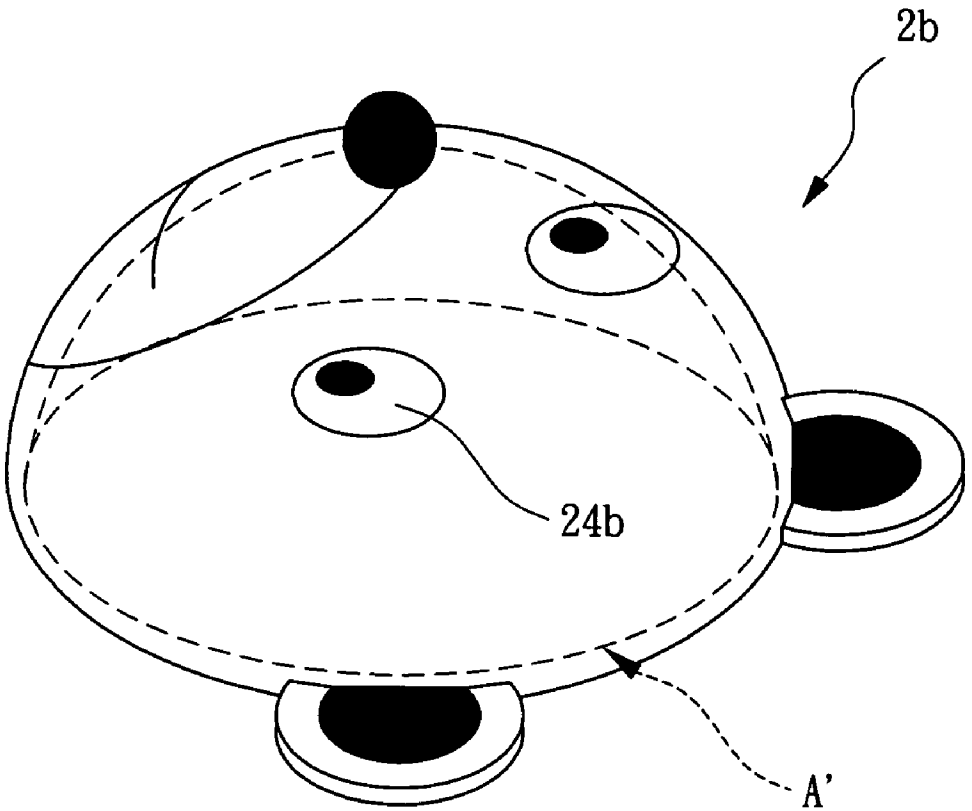
FIG. 4D is a three-dimensional structural view that shows the third preferred embodiment of an auxiliary modeling structure according to the invention.

FIG. 4D is a three-dimensional structural view that shows the third preferred embodiment of an auxiliary modeling structure according to the invention. In this embodiment, each auxiliary modeling unit 2*b* is made of polyethylene foam and formed into another curved surface via hot pressing; the preferable forms of the auxiliary modeling unit 2*b* is semi-sphere or semi-ellipsoid, but may be shaped into other forms according to different needs. The auxiliary modeling unit 2*b* may further include a pattern 24*b* disposed thereon via methods including printing, embroidering, adhering, and sewing.

Figure 4E:
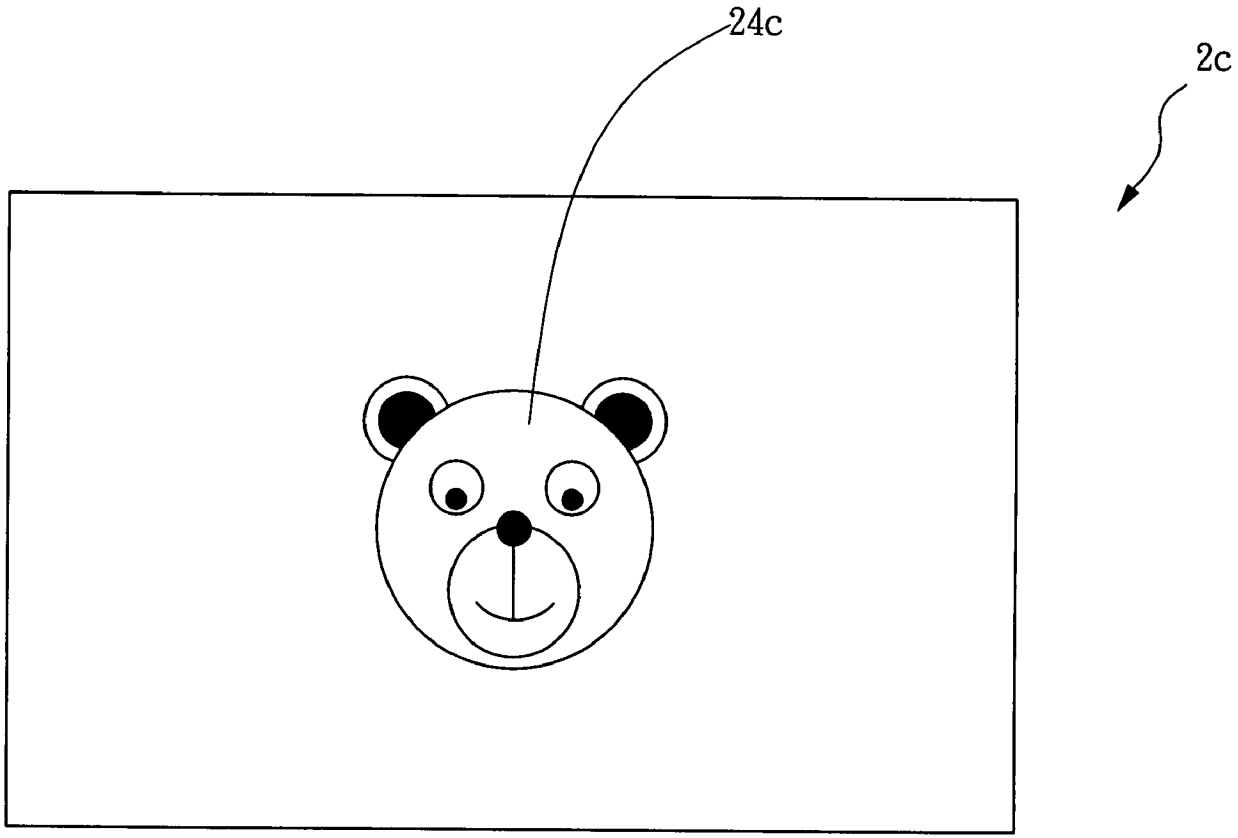
FIG. 4E is a three-dimensional structural view that shows the fourth preferred embodiment of an auxiliary modeling structure according to the invention.

FIG. 4E is a three-dimensional structural view that shows the fourth preferred embodiment of an auxiliary modeling structure according to the invention. To facilitate the manufacturing process, each auxiliary modeling unit 2*c* is planar and has a pattern 24*c* disposed thereon via methods including printing, adhering, and sewing.

Figure 4F:
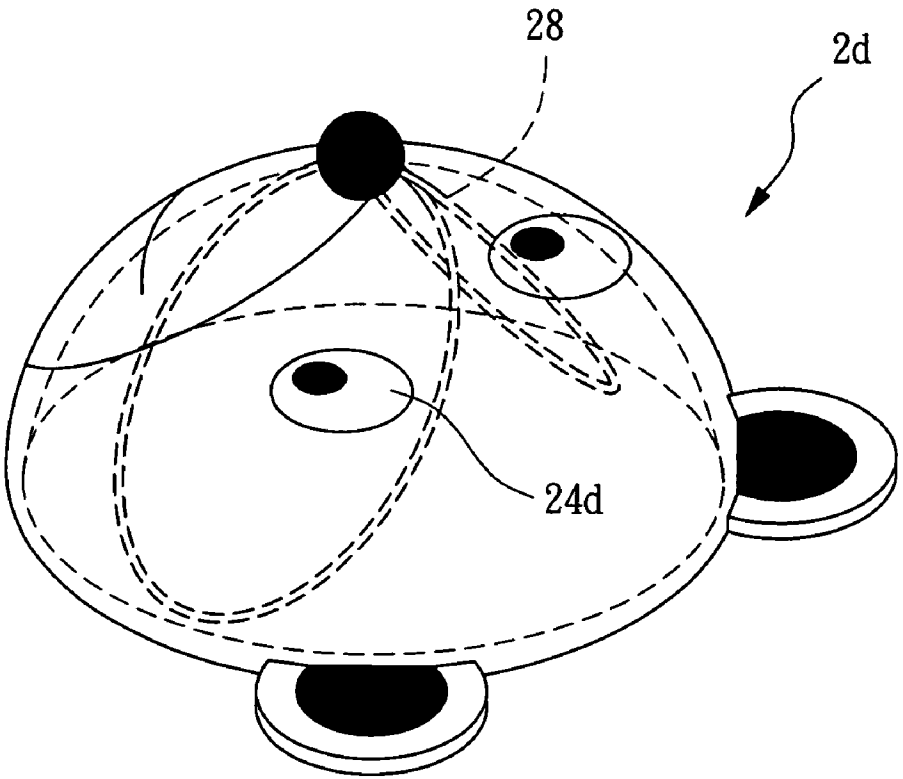
FIG. 4F is a three-dimensional structural view that shows the fifth preferred embodiment of an auxiliary modeling structure according to the invention.

FIG. 4F is a three-dimensional structural view that shows the fifth preferred embodiment of an auxiliary modeling structure according to the invention. As shown in the figure, each auxiliary modeling unit 2*d* further comprises at least one frame 28 aligned in a predetermined arrangement. The frame 28 uphold the auxiliary modeling unit 2*d* in order to form another curved surface and yet make the auxiliary modeling unit 2*d* three-dimensional, and the auxiliary modeling unit 2*d* may further include a pattern 24*d* disposed thereon via methods including printing, embroidering, adhering, and sewing.

Figure 5A:
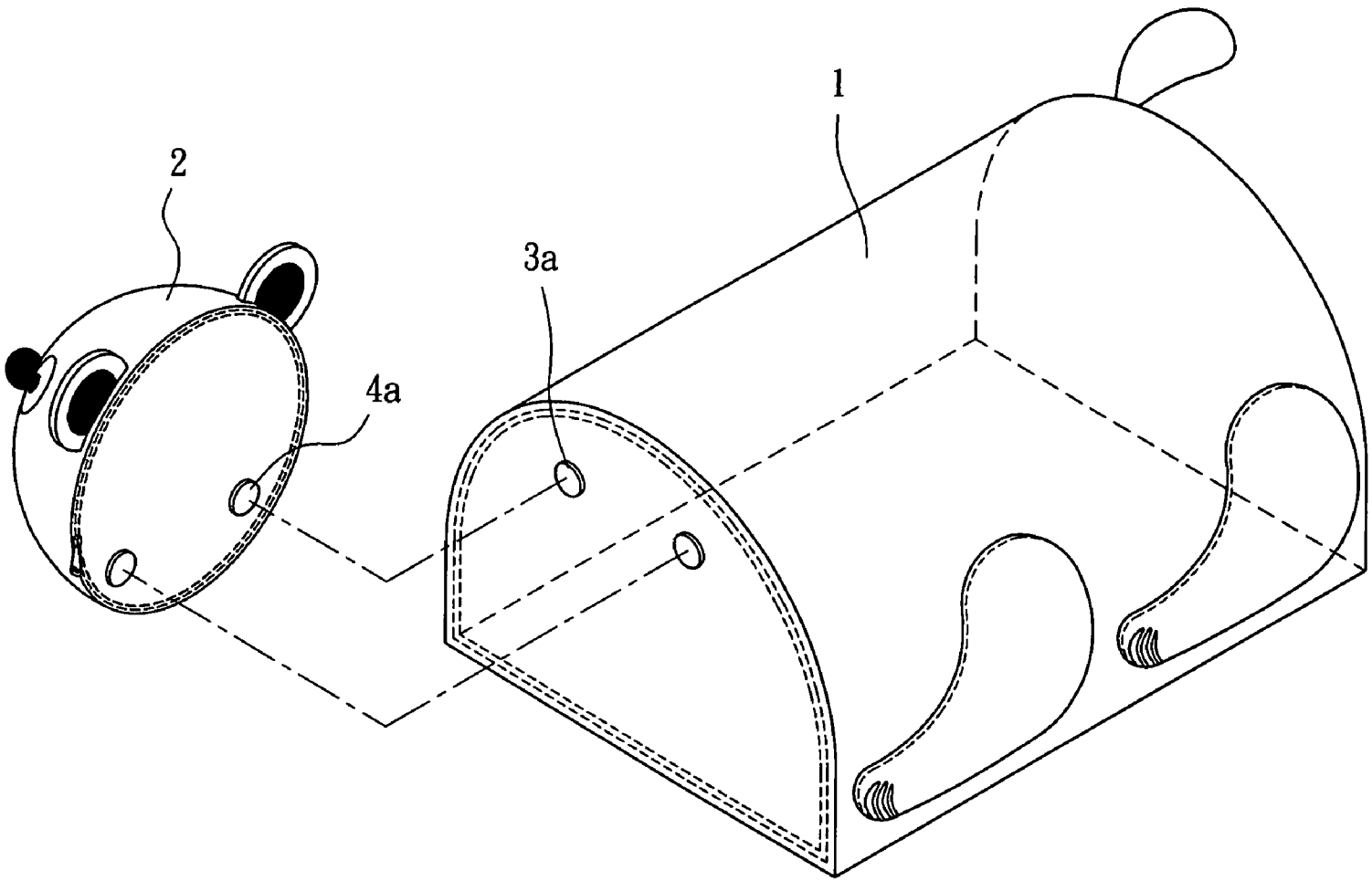
FIGS. 5A to 5E are three-dimensional structural views that show several preferred embodiments of the first and the second connecting parts according to the invention.
Figure 5B:
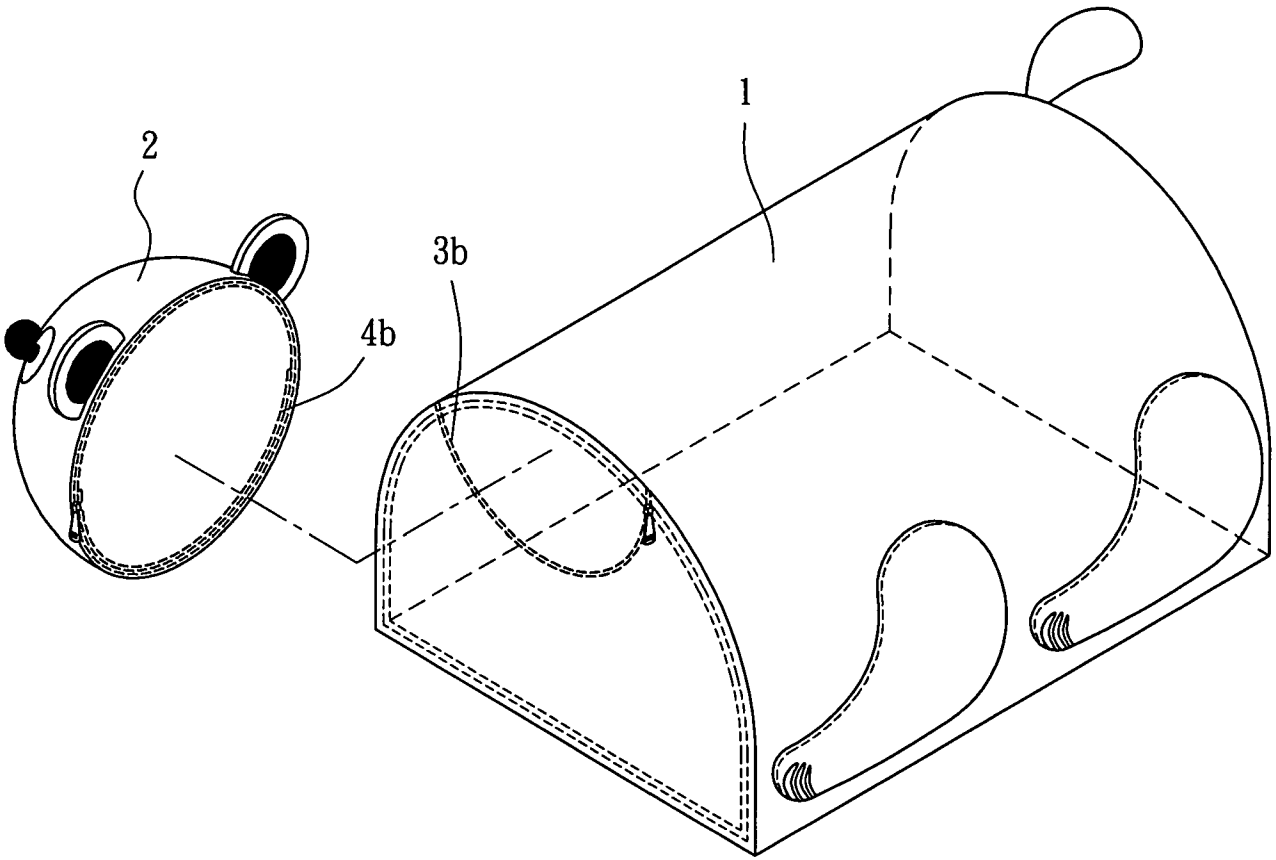
Figure 5C:
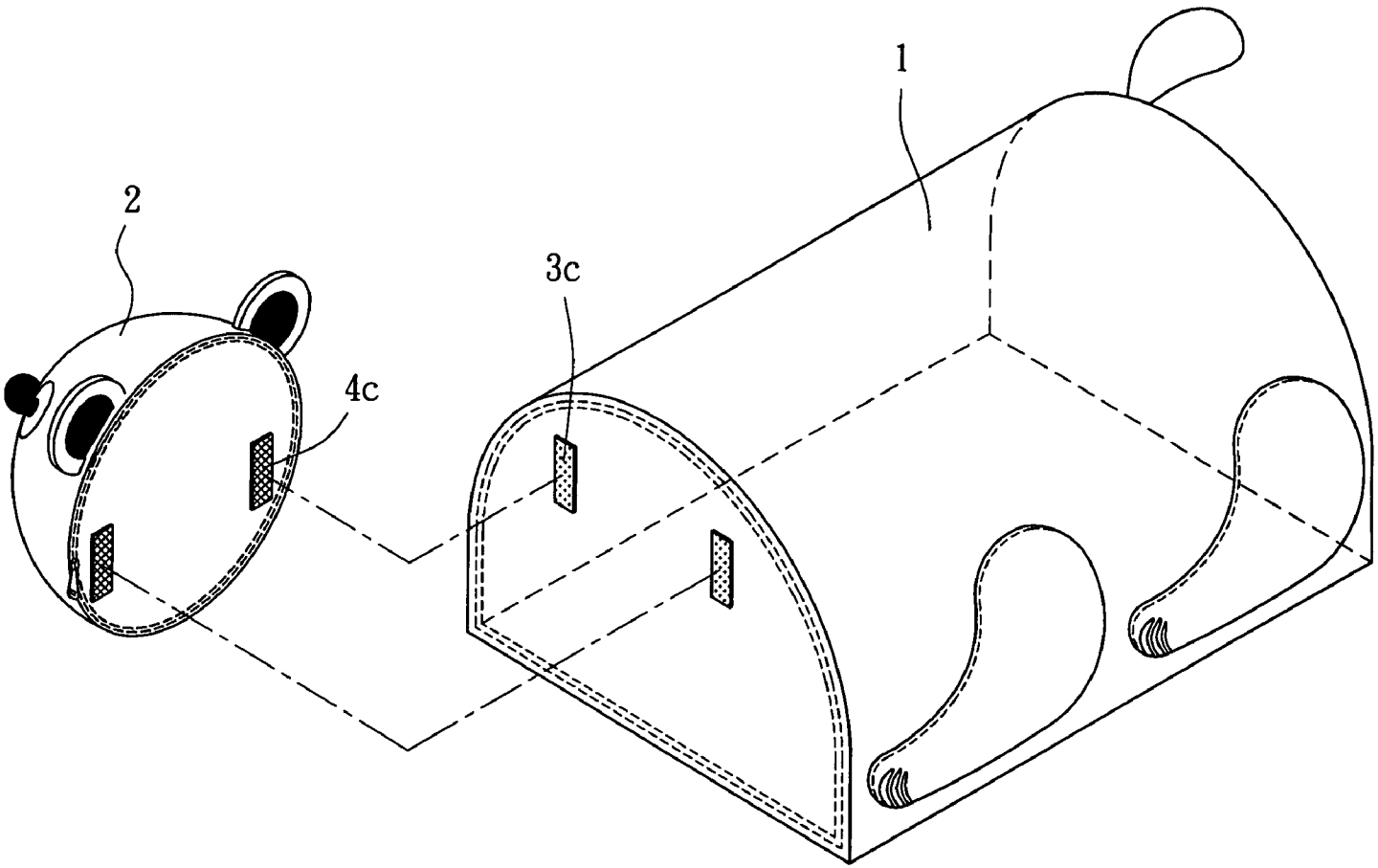
Figure 5D:
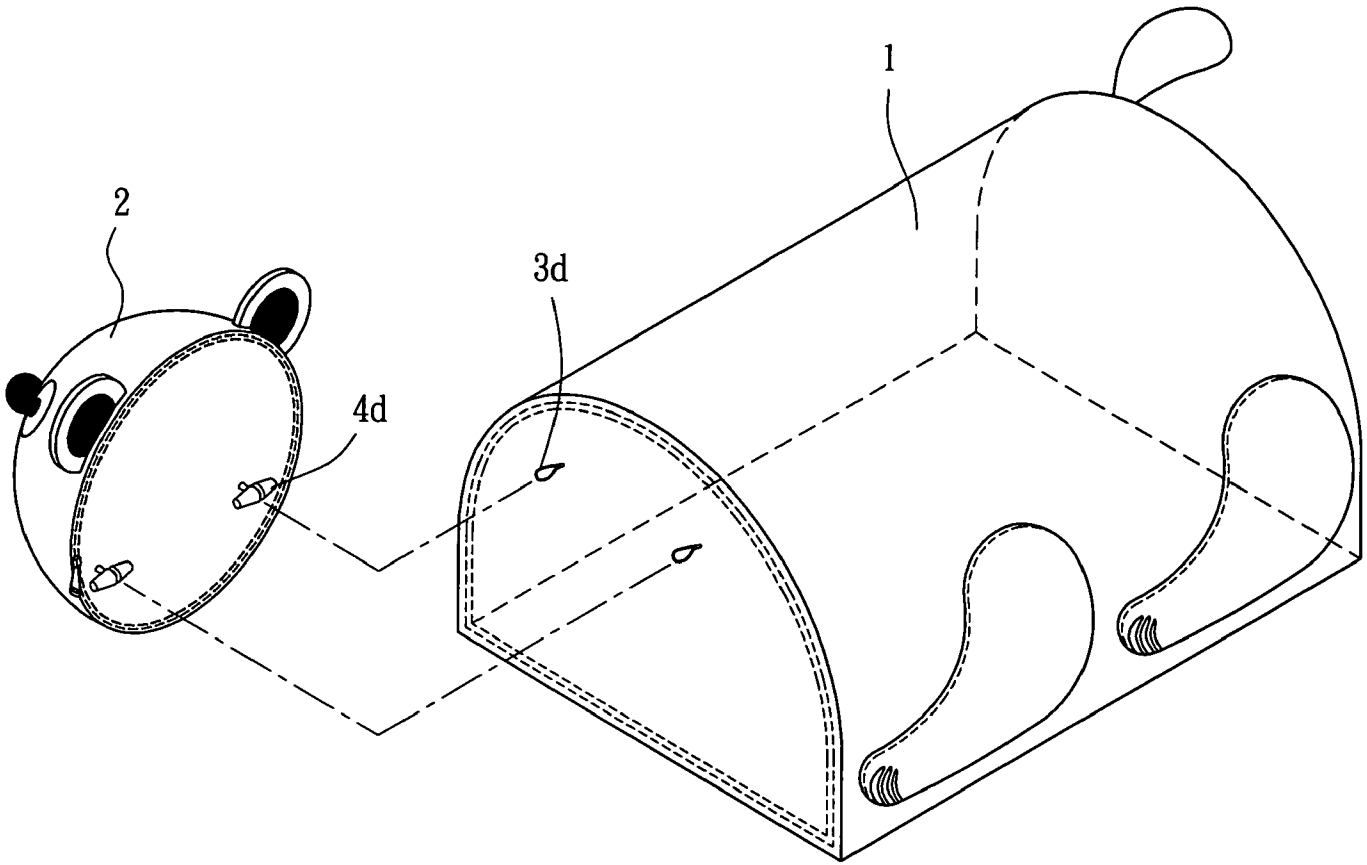
Figure 5E:
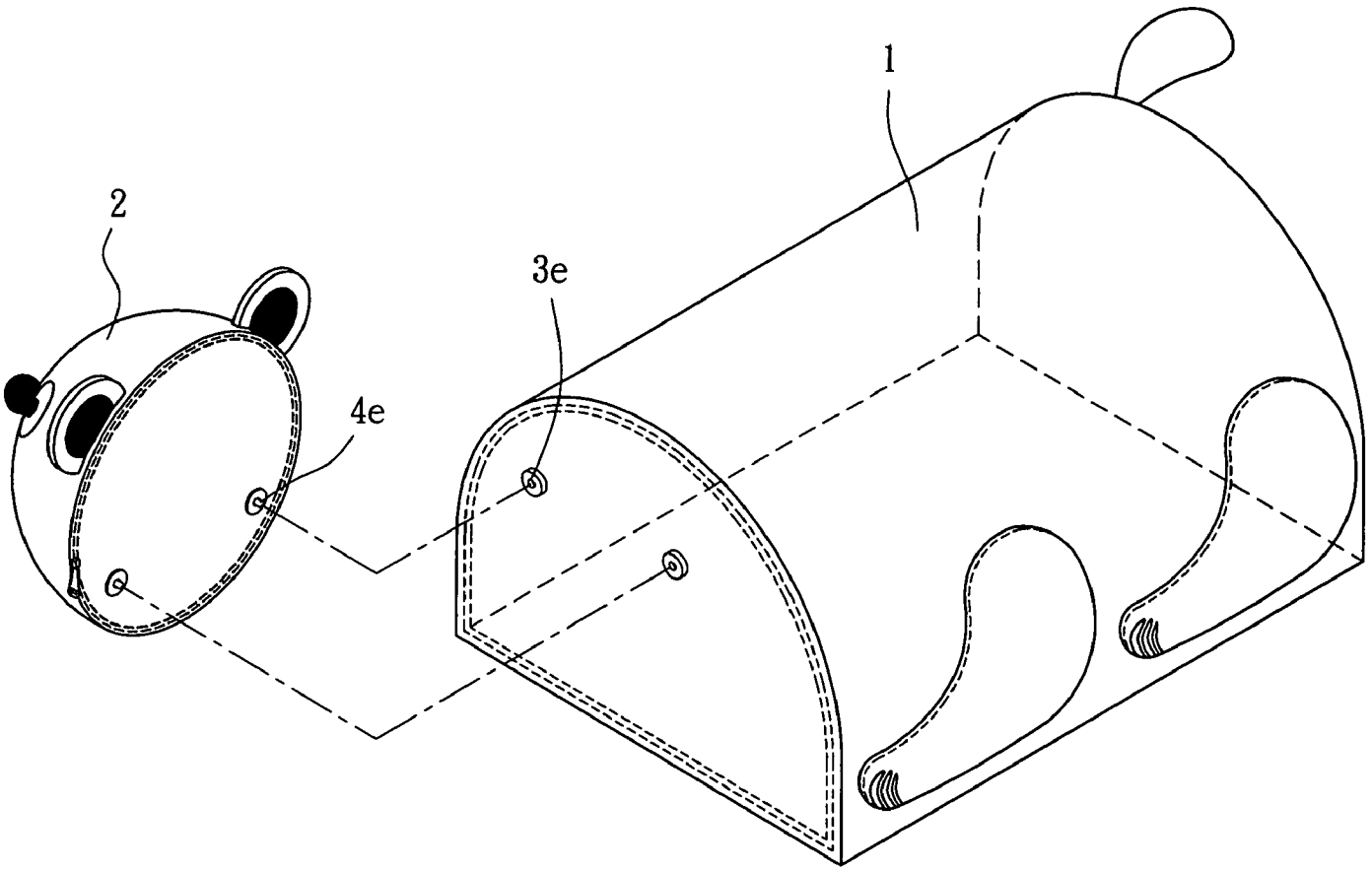

Referring to FIGS. 5A to 5E, which are three-dimensional structural views that show several preferred embodiments of the first and the second connecting parts according to the invention. In FIG. 5A, the first connecting part 3*a* and the second connecting part 4*a* are magnets of opposite magnetic polarity. Therefore, when the first connecting part 3*a* is placed close to the second connecting part 4*a*, the magnets of opposite magnetic polarity is attracted toward each other, thereby allowing the auxiliary modeling unit 2 to be attached onto the frame body 1 of the playhouse. As shown in FIG. 5B, the first connecting part 3*b* and the second connecting part 4*b* are zippers. Whereas in FIG. 5C, the first connecting part 3*c* and the second connecting part 4*c* are nylon fasteners. Refer to FIG. 5D, the first connecting part 3*d* and the second connecting part 4*d* are slip-on buttons, which are attached together by clasping. As shown in FIG. 5E, the first connecting part 3*e* and the second connecting part 4*e* are clip-on buttons, which are attached together by clasping. Moreover, the first connecting part 3 and the second connecting part 4 may also be buttons, clips, clamps, or hooks. As it will be understood by one ordinarily skilled in the art that numerous variations of the first and the second connecting parts 3, 4 will be possible to the disclosed embodiment without departing from the scope of the invention, and thus the variations of the structures and figures will not be described further herein.

Figure 6A:
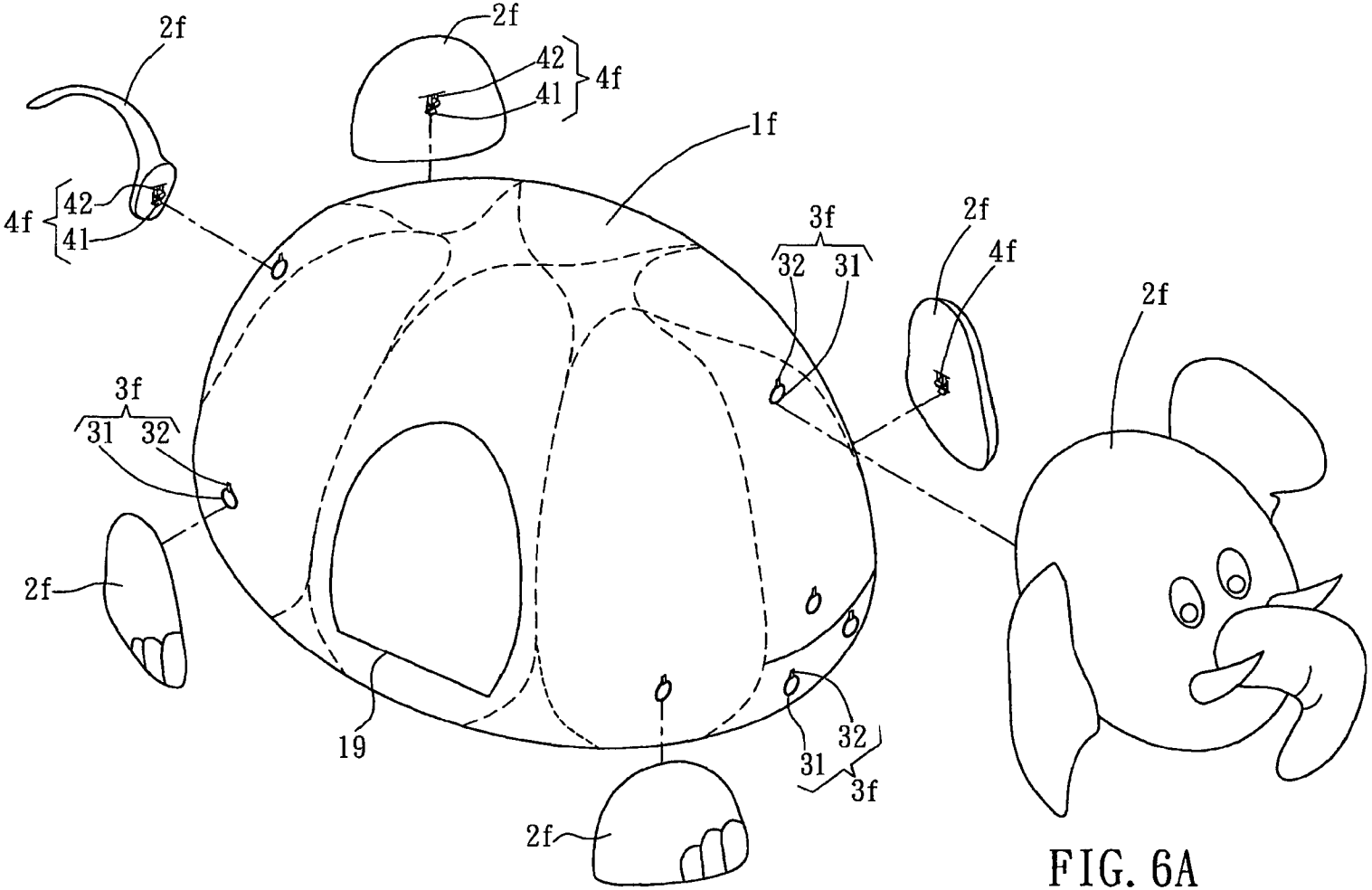
FIG. 6A is an exploded view that shows the sixth preferred embodiment of an auxiliary modeling structure according to the invention.
Figure 6B:
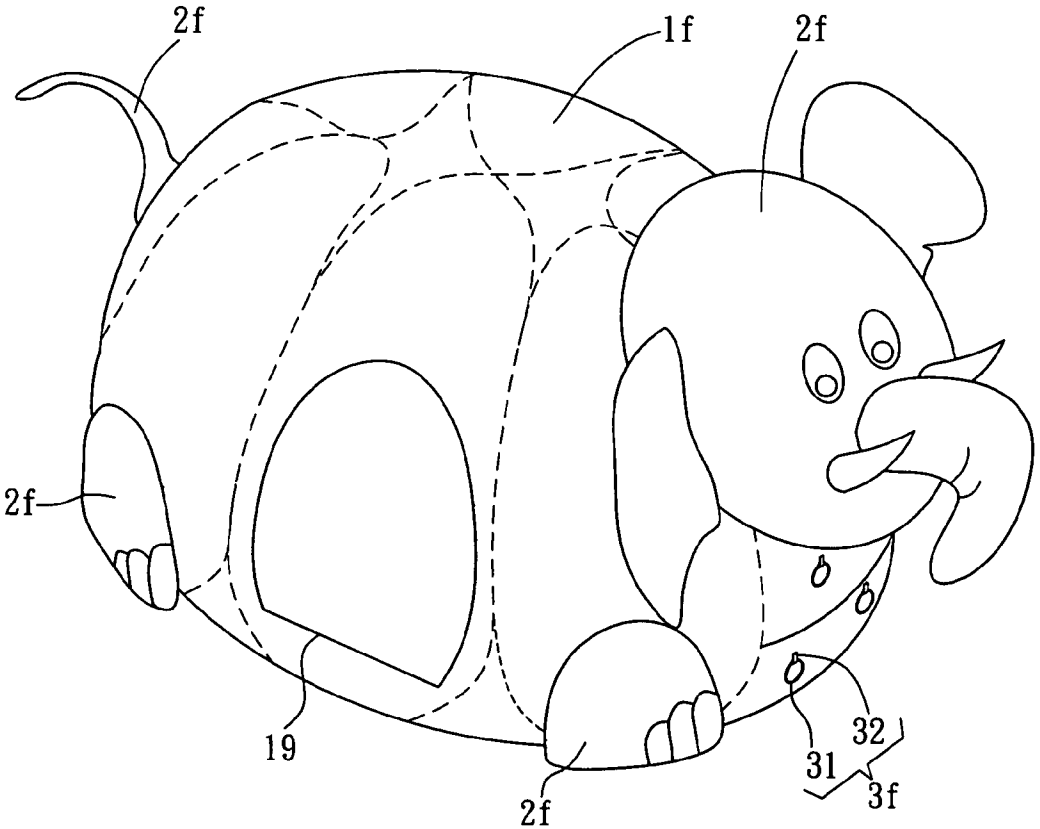
FIG. 6B is an assembled view showing the auxiliary modeling structure of FIG. 6A.
Figure 7:
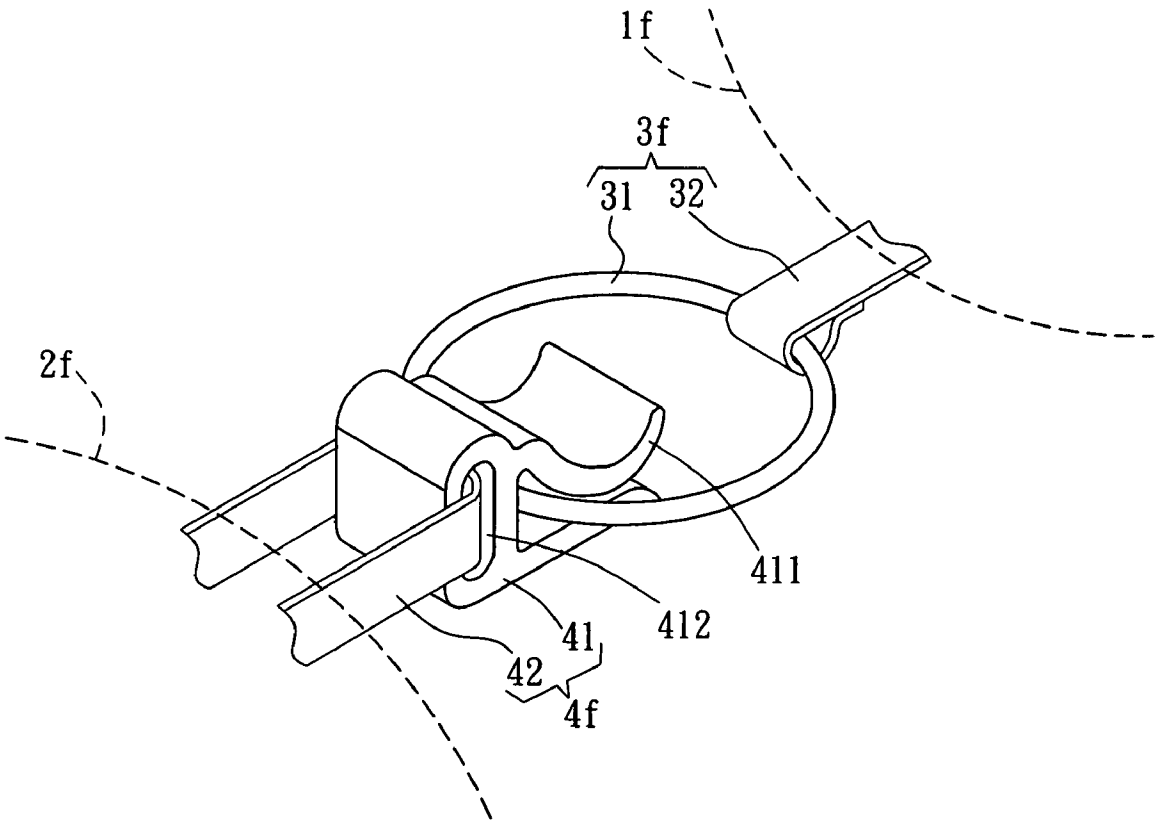
FIG. 7 is a partially enlarged view showing the first and the second connecting parts of the auxiliary modeling structure shown in FIG. 6A.

Referring to FIGS. 6A, 6B and 7, in which FIG. 6A is an exploded view that shows the sixth preferred embodiment of an auxiliary modeling structure according to the invention; FIG. 6B is an assembled view showing the auxiliary modeling structure of FIG. 6A; and, FIG. 7 is a partially enlarged view showing the first and the second connecting parts of the auxiliary modeling structure shown in FIG. 6A.

As shown in FIGS. 6A, 6B and 7, each first connecting part 3*f* further includes a positioning ring 31 and a first connecting strip 32. In this embodiment, the first connecting strip 32 is made of soft or flexible materials such like cotton cloth or nylon cloth and is firstly passing through the positioning ring 31 and then sewn to a predetermined location of the frame body 1*f*. Such that, the positioning ring 31 can be connected to the predetermined location of frame body 1*f*. Each second connecting part 4*f* further includes a positioning clip 41 and a second connecting strip 42. In this embodiment, the positioning clip 41 is made of plastic, rubber or the like, and further includes an opening portion 411 at a front end thereof and a through hole 412 at its rear end. The opening portion 411 is shaped like a duck beak and has a slightly enlarged opening at its front portion which is larger than the thickness of the positioning ring 31. The size of opening of a middle portion of the opening portion 411 is slightly smaller than the thickness of the positioning ring 31. The size of opening of a rear portion of the opening portion 411 is slightly larger than the thickness of the positioning ring 31. Therefore, the positioning ring 31 can be readily plugged into the rear portion of the opening portion 411 from the slightly enlarged front portion thereof, and then be constrained by the narrowed middle portion of the opening portion 411 so as to avoid it from dropping out of the opening portion 411. The second connecting strip 42 is made of soft or flexible materials such like cotton cloth or nylon cloth and is firstly passing through the through hole 412 of positioning clip 41 and then sewn to a predetermined location of the auxiliary modeling unit 2*f*. Such that, the positioning clip 41 can be connected to the predetermined location of auxiliary modeling unit 2*f*. Therefore, by using the positioning clip 41 of second connecting part 4*f* to clip the positioning ring 31 of first connecting part 3*f*, the auxiliary modeling unit 2*f* can be connected to the predetermined location of the frame body 1*f*. The auxiliary modeling unit 2*f* can also be detached from the frame body 1*f* easily by pulling the positioning ring 31 out of the opening portion 411 of positioning clip 41.

In the present invention, the furnishing locations of the first connecting parts 3*f* and second connecting parts 4*f* can be swapped. The combination of the first and second connecting parts 3*f*, 4*f* substantially forms a connecting module which attaches the auxiliary modeling units 2*f* onto the predetermined locations of the frame body 1*f* in a detachable manner so as to make the playhouse shaped like a three-dimensional animal, fruit, daily utensil, transportation, or etc. In addition, a zippered door 19 is furnished on a side surface of cover 12 so as to allow the children to enter the inner empty compartment of the frame body 1*f*.

The playhouse and the auxiliary modeling structure of the invention have the following advantages:

1. Easy to store: the playhouse and the auxiliary modeling structure are comprised of fabrics and supporting frames, and the supporting frames are wrapped up within the fabrics. The inherent elasticity of the supporting frame allows the playhouse to be promptly unfolded, and the playhouse may be put away for storage by simply folding up the supporting frames.

2. Stylish: The specifically designed arch shaped of the playhouse (or shell-shaped) allows it to become more similar to the forms of animals, and thus the playhouse may be made into the forms of a variety of animals.

3. Specifically designed for children: In addition to serving as the playground for children, parents can also enhance the bonding with their children by creatively using the playhouse. The playhouse is suitable for children of all ages and may stimulate their imagination and creativity by allowing children to exercise role-playing and develop common senses. As a result, children are allowed to learn and play all the time.

4. Educational: As children get more and more toys, the house would become constantly strewn with toys and messy, and the playhouse would come in handy. Toys may be collectively stored into the playhouse, which not only allows the children to play, but also allows parents to train their children to tidy up after themselves, so that the children may develop the habit of cleaning up on their own since when they are young.

5. Comfortable and safe: The fine fabrics allows for high comfort to children, and the elongated bottom surface allows them to fully stretch and lie down within the playhouse, so that children may play and nap therein. As children get older, they also become more active, and it becomes difficult to handle chores and take care of children at the same time. The playhouse may serve as a shelter for children, with which parents may keep children safely within the playhouse by sealing it at both sides, while also keep them from getting bored by putting toys therein. Moreover, the playhouse may also serve as a mosquito net that protects children from mosquito bites.

The present invention has been described with preferred embodiments thereof, and it is understood that many changes and modifications to the described embodiment can be carried out without departing from the scope and the spirit of the invention that is intended to be limited only by the appended claims.

What is claimed is:

1. An assembly of auxiliary modeling structure and playhouse, comprising:

a playhouse having a frame body, the frame body having a bottom surface of a predetermined area and a cover which encloses and defines the bottom surface, two lateral sides of the cover are respectively formed into a first curved surface;

at least one first connecting part furnished on the cover of frame body;

at least one auxiliary modeling unit, each auxiliary modeling unit having an external surface which defines an attachable surface of a predetermined area, the external surface forming a second curved surface;

at least one second connecting part furnished on the auxiliary modeling unit, the second connecting part is capable of connecting with the first connecting part in a detachable manner so as to position the auxiliary modeling unit onto the cover of frame body in a detachable manner; and wherein the playhouse further comprises several supporting frames aligned in a predetermined arrangement, each supporting frame includes at least two arc-shaped surfaces, at least one overlapping end, and two pressing ends; each of the two pressing ends respectively presses against inner edges of the bottom surface and upholds the cover away from the bottom surface; wherein the arc-shaped surfaces, overlapping end and pressing ends of each supporting frame are formed by bending a single continuous metal wire into a shape of "8".

2. The assembly according to claim 1, wherein the first and second connecting parts are chosen from one of the following: magnets with opposite magnetic polarities, zippers and nylon fasteners.

3. The assembly according to claim 1, wherein the first connecting part and the second connecting part are attached to each other by using one of the following fasteners: clasping, binding, and clamping.

4. The assembly according to claim 1, wherein at least one trough is openly formed in each of the auxiliary modeling units, and each trough has two edges and a top where the two edges converge;

wherein the two edges are connected so that the auxiliary modeling unit becomes three-dimensional; and wherein the two edges are connected together by one of the following fasteners: sewing, zipping, laminating, and adhering.

5. The assembly according to claim 1, wherein the second curved surface is formed with a predetermined pattern disposed on the external surface thereof by means of one of the following fasteners: printing, embroidering, adhering, and sewing.

6. An assembly that includes a playhouse having an auxiliary modeling structure, comprising:

a frame body, the frame body further having a bottom surface of a predetermined area and a cover enclosing the bottom surface;

at least one auxiliary modeling unit, each auxiliary modeling unit having an external surface which defines an attachable surface of a predetermined area;

at least one connecting module, each connecting module having a first connecting part and a second connecting part, said second connecting part is connectable with the first connecting part in a detachable manner; wherein one of the first and second connecting parts is furnished on the frame body, while the other one is furnished on the auxiliary modeling unit; and wherein the playhouse further comprises several supporting frames aligned in a predetermined arrangement, each supporting frame includes at least two arc-shaped surfaces, at least one overlapping end, and two pressing ends; each of the two pressing ends respectively presses against inner edges of the bottom surface and upholds the cover away from the bottom surface; wherein the arc-shaped surfaces, overlapping end and pressing ends of each supporting frame are formed by bending a single continuous metal wire into a shape of "8".

7. The assembly according to claim 6, wherein the first and second connecting parts are chosen from one of the following: magnets with opposite magnetic polarities, zippers and nylon fasteners.

8. The assembly according to claim 6, wherein at least one trough is openly formed in each auxiliary modeling unit, and each trough has two edges and a top where the two edges converge; wherein the two edges are connected so that the auxiliary modeling unit becomes three-dimensional; and wherein the two edges are connected together by one of the following methods: sewing, zipping, laminating, and adhering.

* * * * *